United States Patent [19]

Holland et al.

[11] Patent Number: 4,580,641

[45] Date of Patent: Apr. 8, 1986

[54] METHOD AND APPARATUS FOR STARTING DIESEL TYPE HAMMERS

[75] Inventors: Henry A. N. Holland; James Bandura, both of Houston, Tex.

[73] Assignee: Raymond International Builders, Inc., Houston, Tex.

[21] Appl. No.: 489,572

[22] Filed: Apr. 28, 1983

[51] Int. Cl.[4] ..... B25D 9/00

[52] U.S. Cl. ..... 173/134; 123/179 F

[58] Field of Search ..... 173/134, 135, 138, 125; 123/46 R, 46 H, 179 F; 60/576

[56] References Cited

U.S. PATENT DOCUMENTS

| | | | |
|---|---|---|---|
| Re. 28,151 | 9/1974 | Cook | 173/91 |
| 1,102,652 | 7/1914 | Gibb et al. | 61/76 |
| 1,292,429 | 1/1919 | Bull . | |
| 2,804,856 | 9/1957 | Spurlin | 173/135 X |
| 2,951,345 | 9/1960 | Lang | 61/76 |
| 3,109,500 | 11/1963 | Glawon | 173/127 |
| 3,283,832 | 11/1966 | Spannhake et al. | 173/126 |
| 3,474,870 | 10/1967 | Cook | 173/91 |
| 3,511,325 | 5/1970 | Schmidt | 173/131 |
| 3,583,499 | 6/1971 | Cordes | 173/131 |
| 3,626,918 | 12/1971 | Brenneke | 123/179 F |
| 3,667,442 | 6/1972 | Bredlow | 123/179 F |
| 3,815,373 | 6/1974 | Giroux | 61/53.5 |
| 3,920,083 | 11/1975 | Makita | 173/49 |
| 4,007,803 | 2/1977 | Airhant | 173/135 X |
| 4,131,164 | 12/1978 | Hague et al. | 173/1 |
| 4,159,039 | 6/1979 | Kasuga et al. | 173/1 |
| 4,162,668 | 7/1979 | Jacob et al. | 123/179 F |

FOREIGN PATENT DOCUMENTS

| | | | |
|---|---|---|---|
| 3042292 | 5/1981 | Fed. Rep. of Germany | 123/179 F |
| 2018903 | 10/1979 | United Kingdom | 123/179 F |

OTHER PUBLICATIONS

"Model 520 Diesel Pile Hammer"—1 page advertisement of International Construction Equipment Inc.

*Primary Examiner*—E. R. Kazenske
*Assistant Examiner*—Willmon Fridie, Jr.
*Attorney, Agent, or Firm*—Fitzpatrick, Cella, Harper & Scinto

[57] ABSTRACT

A self starting diesel hammer (20) having a tubular casing (30) inside which a heavy ram (32) is driven up by means of an explosion and then falls back onto an anvil (46) while compressing air under the ram so that fuel injected under the ram (32) causes the air to explode and drive the ram (32) up again, and a source of compressed gas (106) and a valve (110) arranged to direct the gas under the ram (32) to throw it upwardly in the casing (30) to start operation of the hammer.

7 Claims, 11 Drawing Figures

22
70
68
20
180
74
72
106
38
34
78
30
32
112
83
COMPRESSED AIR
108
82
110
36
40
FUEL IN
104
102
46
100
98
54
101
58
48
50a
50
52
28
24
26

22
70
68
20
74
34
38
72
32
106
78
30
40
113
112
113
36
COMPRESSED AIR
83
108
82
110
102
FUEL IN
104
46
100
98
54
101
50a
48
50
58
58
52
28
24
26

4
106
30
112
113
5
COMPRESSED AIR SUPPLY
116
114
108
120
110
118
122
7
7
131
124
5
4

106
112
113
108
118
122
120
124

METHOD AND APPARATUS FOR STARTING DIESEL TYPE HAMMERS

CROSS REFERENCE TO RELATED APPLICATION

This application contains subject matter related to U.S. patent application Ser. No. 405,615, filed Aug. 15, 1982, now U.S. Pat. No. 4,473,123.

BACKGROUND OF THE INVENTION

1. Field of the Invention

This invention relates to diesel type pile driving hammers and in particular it concerns novel methods and apparatus for starting such hammers.

2. Description of the Prior Art

Diesel type pile driving hammers are well known in the construction industry. One example is the Model 520 Diesel Pile Hammer supplied by International Construction Equipment, Inc., 301 Warehouse Drive, Matthews, N.C.

In a typical diesel hammer, a heavy ram falls in a cylinder onto an anvil mounted on the top of a pile. The impact of the ram on the anvil drives the pile down. During the fall of the ram, the air under the ram is compressed into one or more pockets formed in the upper surface of the anvil. At the time the ram strikes the anvil, fuel is admitted to the anvil pockets and mixes with the compressed air and explodes to drive the ram back up inside the cylinder for another stroke. During the rise and subsequent fall of the ram, it passes by exhaust and inlet ports in the cylinder to allow discharge of the products of combustion and admission of fresh air to be compressed. Thus, once the hammer begins operation it continues to operate in an automatic manner.

Various techniques have been proposed to start the operation of diesel type hammers. The most common technique for starting a diesel hammer, involves lifting the ram inside the casing with a rope and then releasing the ram so that it falls down through the cylinder with sufficient force to compress the air trapped in the cylinder between the ram and the anvil. Then, when fuel is injected into the cylinder it will explode to drive the ram upwardly. Other techniques which have been proposed for starting the operation of a diesel hammer involve the use of a hydraulic piston and cylinder assembly mounted alongside the hammer casing. The piston rod is connected, via a releasable latch which extends through a slot in the casing, to a ledge or lip formed in the ram. When the piston and cylinder assembly is energized the piston pulls the piston rod, latch and ram upwardly. When the ram reaches a predetermined height, the latch is tripped, allowing the ram to fall.

The known prior art diesel hammer starting techniques and mechanisms are relatively complicated and are subject to malfunction. Also they require the formation of elongated slots along the hammer casing which constitutes a potential weakness in its construction.

It as also known, as described in copending U.S. patent application Ser. No. 405,615, filed Aug. 5, 1982 and assigned to the assignee of the present invention, to use a compressed gas to drive the ram of a diesel hammer up against an upper anvil so that the hammer can be used for upward pulling as well as for downward driving. The compressed gas techniques as described in that patent application, however, is not used for starting the diesel operation. In fact, in its operation the diesel hammer air inlet and exhaust ports are closed and the compressed gas, in addition to driving the ram upwardly, also cushions the downward fall of the ram so that it does not drive downwardly on the anvil.

SUMMARY OF THE INVENTION

The present invention overcomes the above discussed problems of the prior art and provides novel methods and apparatus for starting the operation of a diesel hammer without need for complex and unreliable mechanical devices and without need for a slot formed along the hammer casing or cylinder.

According to one aspect of the invention there is provided a novel diesel hammer having self start capability. This novel hammer comprises a cylindrical casing with an anvil at its lower end and air inlet and exhaust ports formed in the casing above the anvil. A fuel injector is also provided for injecting combustable fuel into the casing at the anvil. A ram is closely fitted inside the casing to move up from said anvil past the air inlet and exhaust ports to a predetermined level in the casing from which the ram may fall and entrap and compress air in the lower end of the casing and to deliver a blow to the anvil. There is also provided a source of compressed gas and a conduit interconnecting the source of the gas and the inside of the casing below the ram as it rests on the anvil. A valve is interposed along the conduit and a valve operating mechanism is associated with the valve to open and close same. The source of compressed gas, the conduit and the valve in its open condition are all arranged and dimensioned to deliver a charge of gas into the casing which is capable of driving the ram upwardly therein at a rate such that when the lower end of the ram clears the inlet and exhaust ports the ram will have sufficient momentum to rise ballistically to the predetermined level in the casing. The ram will then fall back from the predetermined level and when its lower end passes by the air inlet and exhaust ports it will have sufficient velocity to trap and compress air under it as it falls down and strikes the anvil. Fuel injected into the casing at this point will mix with the compressed air causing it to explode to drive the ram back up in the casing. The operation of the hammer then continues automatically.

According to a further aspect of the invention there is provided a novel method of starting operation of diesel hammer of the type in which, by an explosion of compressed air and a charge of fuel injected under a ram which has fallen onto an anvil inside a casing, the ram is driven up off the anvil and past air inlet and exhaust ports in the casing to a predetermined level from which the ram may again fall and entrap and compress air in the lower end of the casing and deliver a blow to the anvil. This novel method comprises the steps of providing a source of compressed gas, directing the compressed gas through a valve into the region under the ram and operating the valve to cause the compressed gas to drive the ram upwardly in the casing such that when the lower end of the ram clears the inlet and exhaust ports the ram will have sufficient momentum to rise ballistically to the predetermined level. The ram will thereafter fall back down through the casing, driving gas out through the air inlet and exhaust ports until the lower end of the ram covers those ports, whereupon the ram will entrap and compress air under it as it falls back down and strikes the anvil. A charge of fuel injected into the casing at this point will mix with the compressed air under the ram, causing it to explode and drive the ram back up inside the casing.

It will be appreciated that the above described novel apparatus and method permit automatic starting of a diesel hammer in a simple and effective manner and without need for complicated and cumbersome mechanisms for lifting and dropping the ram.

A prototype of the invention, made by modification of an ICE Model 520 Diesel Hammer as described herein has been built and successfully tested.

DETAILED DESCRIPTION OF THE PREFERRED EMBODIMENT

Figure 1:
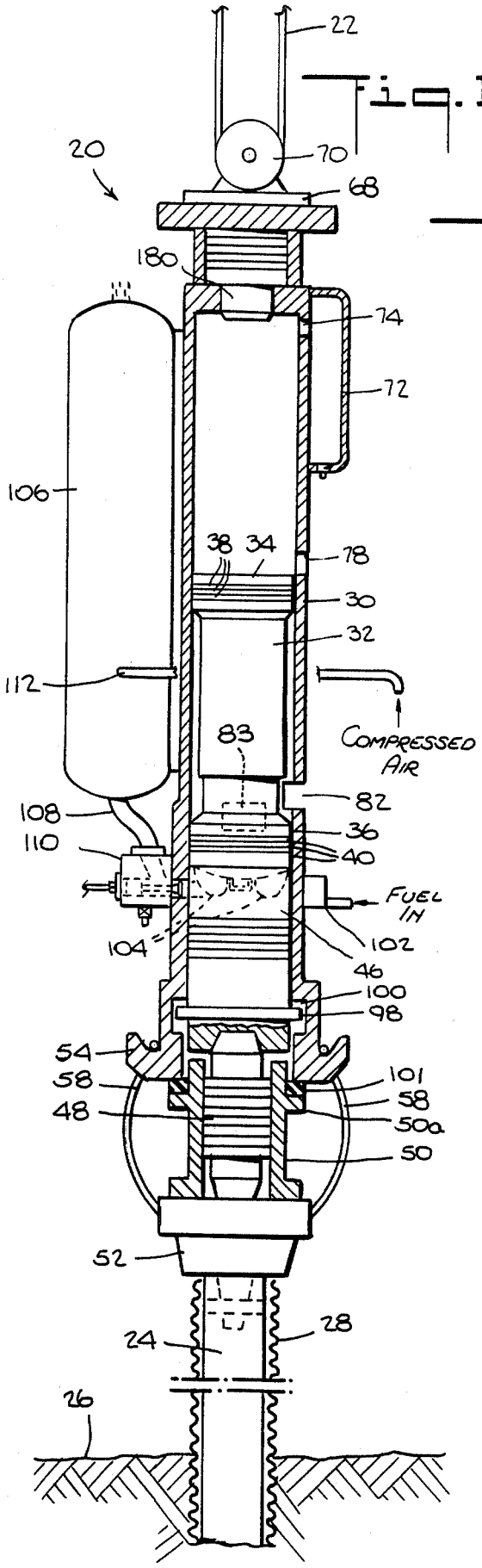
FIG. 1 is a side elevational view showing the interior of a diesel hammer arranged according to the present invention to provide compressed gas starting capability.

As shown in FIG. 1, a diesel hammer, indicated generally as 20, is connected at its upper end to a suspension cable 22 which extends down from a crane (not shown); and the hammer is attached at its lower end to a mandrel or core 24 which is driven by the hammer into the earth 26.

In the application shown, the mandrel or core is made of heavy wall pipe and it fits closely inside a thin wall corrugated shell 28 having a heavy boot plate or cover (not shown) at its lower end. The shell 28 is too fragile to be driven down into the earth but when the heavy wall core 24 is inside the shell, hammer blows can be applied to the upper end of the core and the core and shell can be driven down together. After the core and shell have been driven to a desired depth the core is pulled out and the shell is filled with concrete to form a cast in place pile. It will be appreciated that the hammer may also be used to drive piles directly, i.e. without a core.

As can be seen in FIG. 1, the hammer 20 comprises an outer tubular casing or cylinder 30 which contains a massive ram 32 mounted for up and down movement in the casing. The ram has larger diameter portions 34 and 36 at its upper and lower ends which fit closely, but are freely slideable, inside the casing 30 to guide the ram for its up and down movement therein. Upper and lower piston rings 38 and 40 are mounted on the larger diameter portions of the ram 32. These rings contact the casing wall and provide a pressure seal between the ram and the casing.

Near the bottom of the casing 30, and under the ram 32, there is provided an anvil 46. This anvil is arranged to receive blows from the ram 32 when it drops down through the casing. The anvil rests on a cap block 48 of well known construction and this cap block in turn extends through a cap block housing 50 and rests on the upper end of the core 24. The core 24 is also connected to the hammer via a pulling connection 52 so that after the core is driven it may be pulled out of the shell 28 by lifting up on the hammer. The lower end of the casing 30 is formed with a base adaptor 54 having external grooves 56 which support core slings 58. The core slings extend down from the base adaptor to the pulling connection 52 to suspend it beneath the casing 30. A pulley support 68 and a pulley 70 are mounted on the upper end of the casing 30 and the suspension cable 22 passes through the pulley for lifting the entire hammer assembly.

A bounce chamber 72 is mounted outside the casing 30 near its upper end and communicates with the interior of the casing via bounce chamber ports 74. Also, pressure equalizer vents 78 are arranged in the casing just above the ram 32 in its lower position in the casing. These vents allow the region above the ram and in the bounce chamber to equalize to atmospheric pressure following each drop of the ram.

Figure 2:
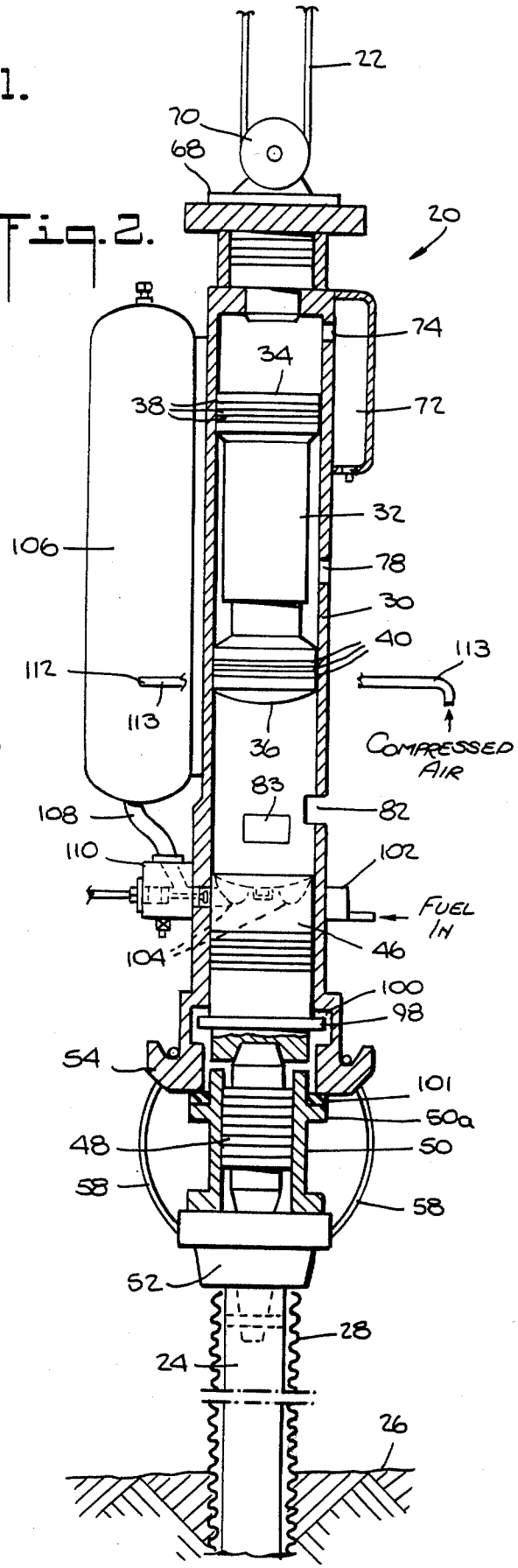
FIG. 2 is a view similar to FIG. 1 but showing the introduction of compressed gas into the hammer to initiate a starting operation.
Figures 3, 4:
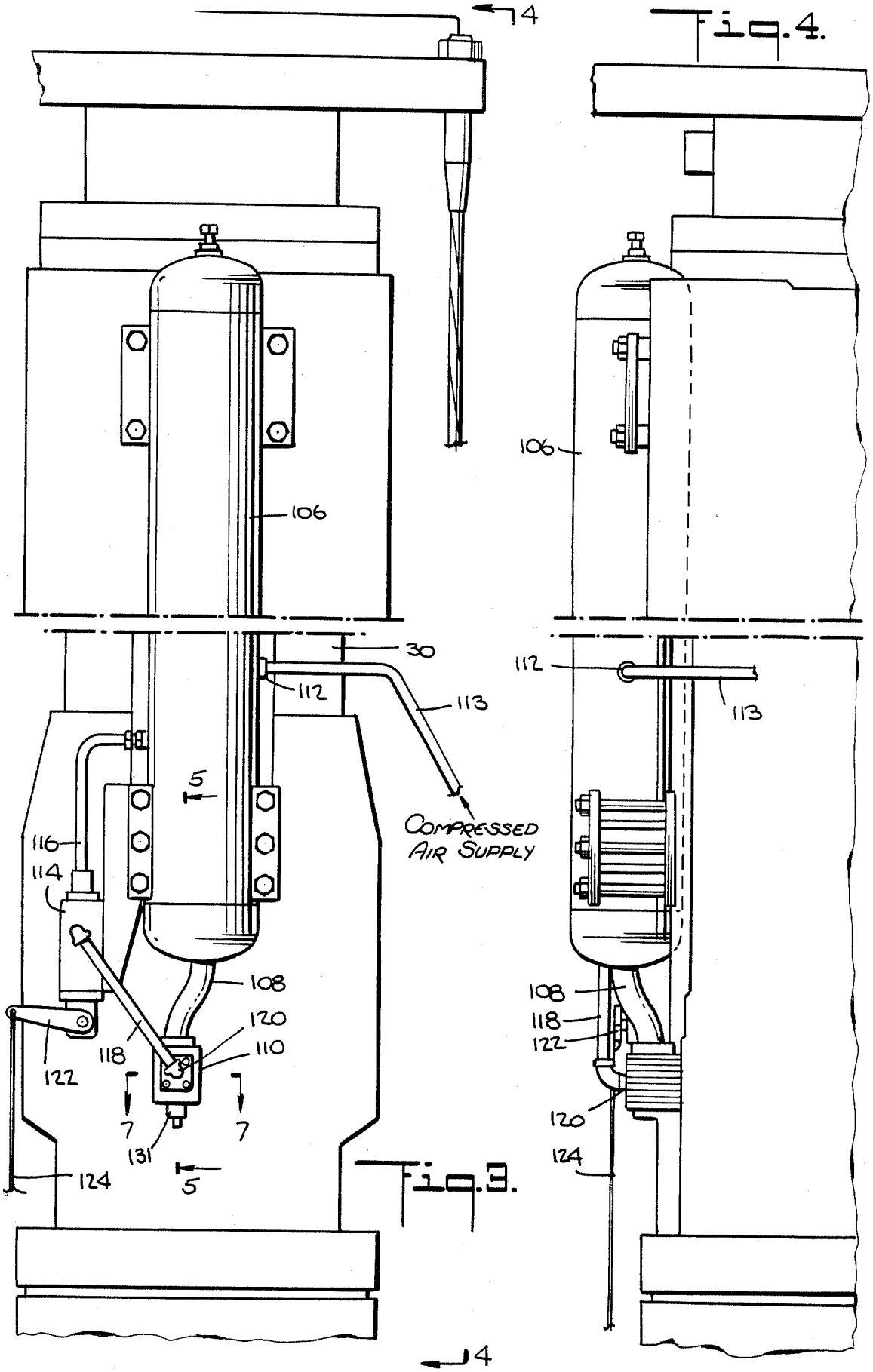
FIG. 3 is an enlarged fragmentary elevational view showing a compressed gas reservoir as well as valve arrangements on the diesel hammer of FIG. 1.
FIG. 4 is a view taken along line 4—4 of FIG. 3.
Figure 5:
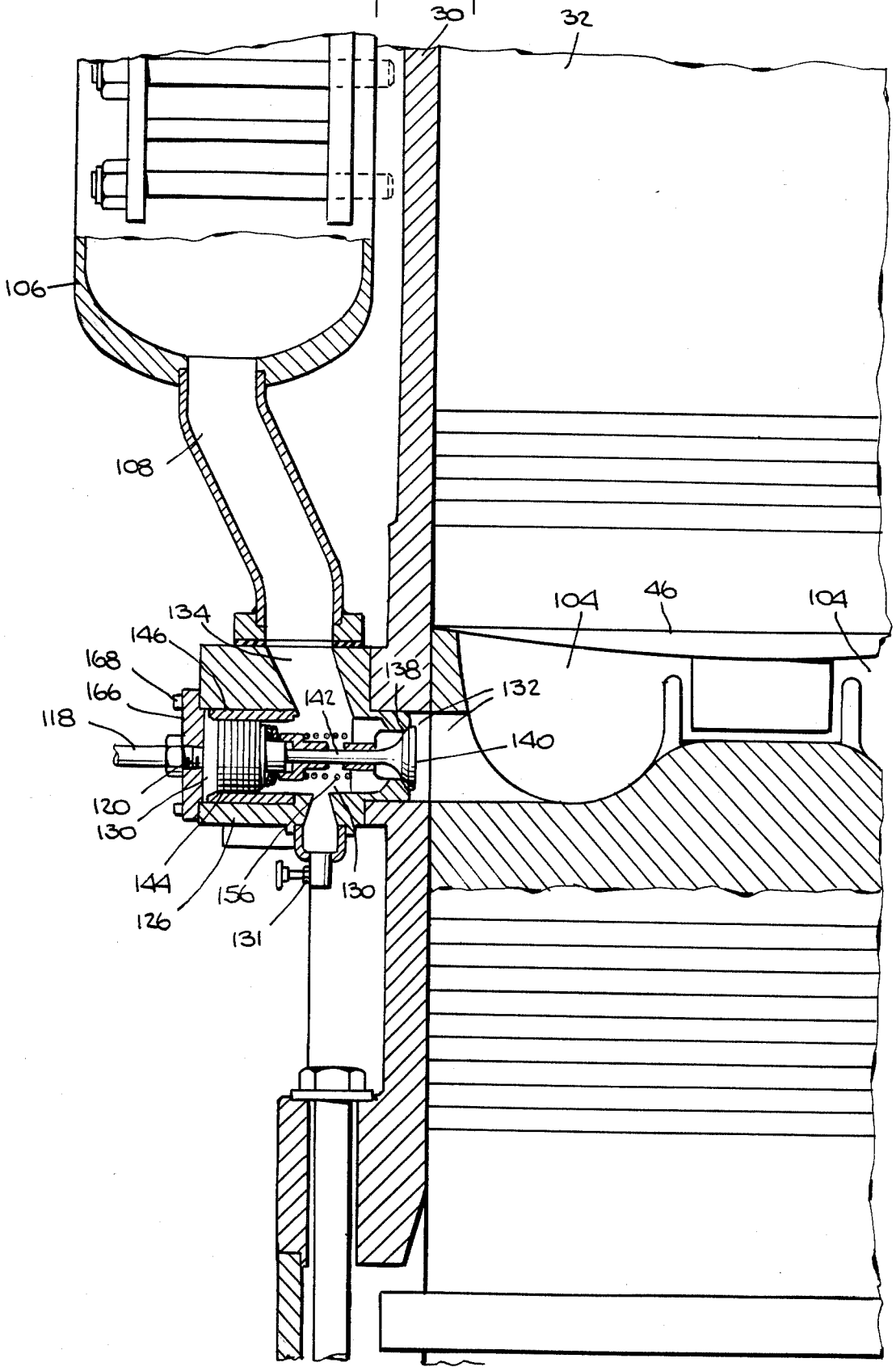
FIG. 5 is an enlarged section view taken along line 5—5 of FIG. 3 and showing a compressed gas supply valve in closed condition.
Figure 6:
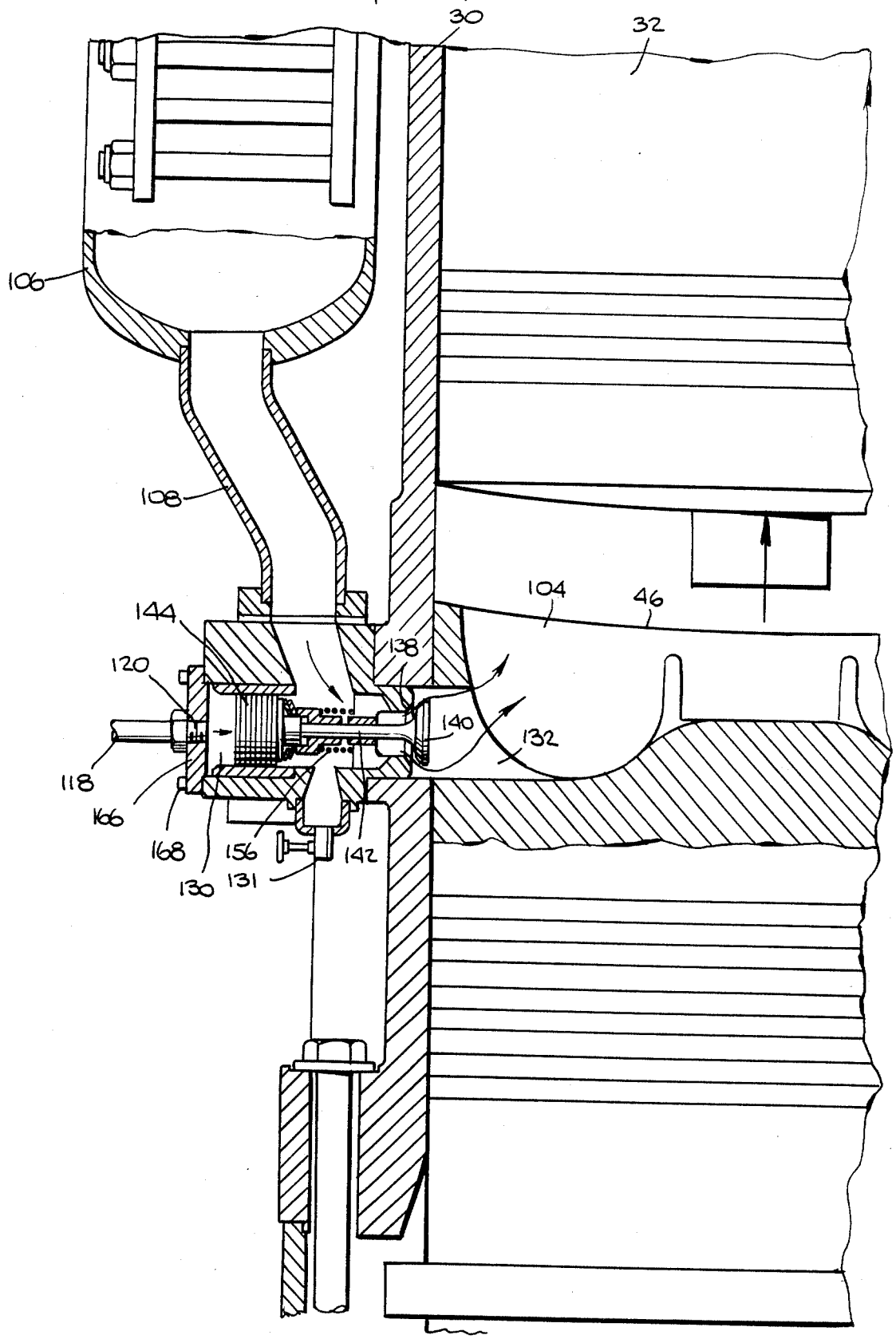
FIG. 6 is a view similar to FIG. 5 and showing the compressed gas supply valve in opened condition.

As shown in FIG. 1 there is provided a large air inlet port 82 in the casing 30 a short distance above the anvil 46. A large exhaust port 83 is also formed in the casing 30 at a location slightly lower than the air inlet port 82 and offset circumferentially with respect to the air inlet port. When the ram 32 is at rest on the anvil 46 as shown in FIG. 1, the region under the ram does not communicate with the air inlet and exhaust ports. However, when the ram rises so that its lower end passes the air inlet and exhaust ports, as shown in FIG. 2, these ports then came into communication with the region under the ram.

The lower end of the anvil 46 is formed with a flange 98 which extends into an annular groove 100 formed in the base adaptor 54. The height of the groove 100 is greater than the thickness of the anvil flange 98. When the hammer is used to apply downward hammer blows to the core 24 the suspension cable 22 is loosened and the base adaptor 54 comes to rest on an annular cushion 101 supported by a flange **50*a* on the cap block housing 50 so that the weight of the casing 30 is supported by the cap block housing while the weight of the ram 32 is supported by the anvil 46 and the cap block 48. As shown in FIG. 1, when the hammer is used to apply downward blows, the core slings 58 become slack and the cap block 48, which rests on top of the core 24, pushes up against the bottom of the anvil 46 and the upper side of the anvil flange 98 approaches the upper surface of the groove 100 in the base adaptor 54. In this case, ram blows on the anvil 46 are transmitted directly through the anvil and the cap block 48 to the top of the core 24. As will be explained hereinafter the present invention may also be used to produce bumpout or uplift blows to force the core 24 up out from the shell 28 if it has become wedged inside the shell during driving. In such case the casing 30 is pulled upwardly by the cable 22 to lift the base adaptor up off the cushion 101 and the flange 50*a* of the cap block housing 50 so that the pulling connection 52 becomes supported by the core slings 58**.

The hammer 20 is also provided with a conventional and well known fuel injection mechanism 102 which supplies diesel fuel into cavities 104 in the anvil 46 as the ram 32 falls and impacts against the anvil.

The hammer 20 as thus far described is the same as the well known ICE Model 520 Diesel Hammer. The modifications according to the present invention which permit starting of the hammer in a novel manner will be described after the following description of the normal operation of the diesel hammer.

In normal operation of the hammer the ram 32 moves up and down inside the casing 32. The upward ram movements are produced by explosions under the ram just as it hits the anvil and the downward movements are produced by the weight of the ram after the force of each explosion has dissipated.

A cycle of operation may be considered with the ram 32 initially located in the upper region of the casing 30 as shown in FIG. 2. The region above the ram 32 and the bounce chamber 72 contains pressurized air which pushes down on the top of the ram. This pressure, plus the weight of the ram, causes the ram to fall rapidly down through the casing 30 toward the anvil 46. As the ram falls, the air under it is initially displaced out through the air inlet and exhaust ports 82 and 83. However, as the lower edge of the ram passes those ports the air under the ram becomes trapped in the casing 30 between the bottom of the ram 32 and the top of the anvil 46. The continued downward movement of the ram, which at this point is very rapid due to the height from which the ram falls as well as the effect of the pressure exerted on the top of the ram, causes the trapped air to become compressed and to increase in temperature. Eventually the ram strikes the anvil, causing a sharp downward blow on the anvil and through the anvil and the cap block 48 to the pile core 24 to drive it down into the earth 26. At about the same time that the ram strikes the anvil, diesel fuel is injected via the fuel injection mechanism 102 into cavities 104 formed in the top of the anvil. This fuel mixes with the highly compressed and very hot air and causes it to explode. The resulting energy drives the ram upwardly in the casing 30. When the bottom of the ram goes past the exhaust port 83 the products of combustion can escape into the atmosphere. At this time the ram has considerable momentum and it continues on up toward the top of the casing. This continued upward movement causes new air to be drawn in through the air inlet port 82 to replace the products of combustion. Also, during the upward ram movement some of the ram's kinetic energy is used to pressurize the air in the upper region of the casing to prevent the ram from hitting the top of the casing. The air which becomes compressed in the upper part of the casing 30 and in the bounce chamber 74 provides a spring effect to force the ram back down in the casing after the upward momentum of the ram has been dissipated. Once the ram again reaches the upper region of the casing and its upward momentum has all been converted to potential energy as well as to compression of the air above the ram, the ram then begins to fall rapidly down through the casing again and the cycle is repeated.

In order to start the above described operation of the hammer 20, the ram 32 must first be lifted up in the casing 30 to a predetermined level from which it can fall and compress air under it so that the air will explode when diesel fuel is admitted into the casing. According to the present invention this lifting is carried out by means of a charge of compressed gas.

As shown in FIGS. 1–5 a gas supply tank 106 is mounted on the outside of the casing 30 and is connected via a gas supply conduit 108 and a gas supply valve 110 to the interior of the casing in the region of the cavities 104 formed in the upper surface of the anvil 46. The gas supply tank 106 has an inlet connector 112 connected to a gas supply line 113 through which a charge of compressed gas, such as air, is supplied from an external source (not shown). There is also provided a pilot valve 114 which is connected via pilot conduits 116 and 118, respectively, to the tank 104 and to a pilot opening 120 in the gas supply valve 110. The pilot valve 114 is shown to be operated manually by means of a crank arm 122 and a pull cord 124, although automatic valve operating means may also be provided. A spring (not shown) is arranged to bias the crank arm 122 upwardly to the position shown in FIG. 3. In this position of the crank arm, the pilot valve 114 prevents flow of pressurized air from the tank 106 via the pilot lines 116 and 118 to the pilot port 120 of the gas supply valve 110. When the pull cord 124 is pulled to move the crank arm 122 downwardly, the pilot valve 114 is opened and compressed air flows from the tank 106 and pilot lines 116 and 118 to the pilot port 120 of the gas supply valve 110 to actuate the valve. As will be seen more fully hereinafter, actuation of the gas supply valve 110 permits a sudden burst of high pressure air from the tank 106 to enter into the region under the ram 32 to drive it upwardly in the casing 30. The flow of air from the tank 106 to the region under the ram 32 continues until the bottom of the ram clears the exhaust port 83, at which time the pull cord 124 is released to allow the pilot valve 114 and consequently the gas supply valve 110 to close.

The ram 32 continues its upward movement in the casing 30 while compressing the air above it. Eventually the upward ram momentum is dissipated and converted to compression of the air in the bounce chamber 72 as well as to potential energy of the ram in the upper region of the casing. The ram then begins to fall in the casing; and after its lower portion passes by the inlet and exhaust ports 82 and 83, the air under the ram becomes trapped inside the casing 30 and becomes compressed and brought to a high temperature. When the ram nears the anvil, diesel fuel is injected into the cavities 104 in the upper portion of the anvil 46 to mix with the hot compressed air and to produce an explosion which drives the ram back up in the casing.

If for some reason an explosion does not occur, the pull cord 124 may be pulled again to supply a fresh burst of compressed air into the region under the ram to drive it upwardly in the casing as described above. Once a proper explosion is achieved, the gas supply valve 110 remains closed and the hammer continues to operate in the normal manner.

The detailed construction of the gas supply valve 110 is best seen in FIGS. 5–9. As shown in those Figures, the valve 110 comprises a valve block 126 which is secured by means of bolts 128 (FIG. 7) to the hammer casing 30. The block 126 is formed with a large diameter central passageway 130 extending toward the casing 30. The casing 30 and the anvil 46 are also formed with a passageway 132 which communicate between the anvil cavities 104 and the passageway 130 formed in the valve block 126. The valve block 126 is also formed with a large diameter inlet passageway 134 which communicates from the upper surface of the block to the central passageway 130. The gas supply conduit 108 is mounted to extend from the inlet passageway 134 to the interior of the gas supply tank 106. A drain valve 131 is mounted in the bottom of the valve block 126 in communication with the central passageway 130 to drain any moisture which has formed in the tank 106.

The valve block 126 has a forward portion 136 which projects into the passageway 132 in the casing 30. the forward end of the portion 136 is fitted with a valve seat 138 of hardened material and a poppet valve 140 rests on the seat 138. The seat 138 and valve 140 may be of the same construction as the poppet valves found in most internal combustion engines.

Figure 7:
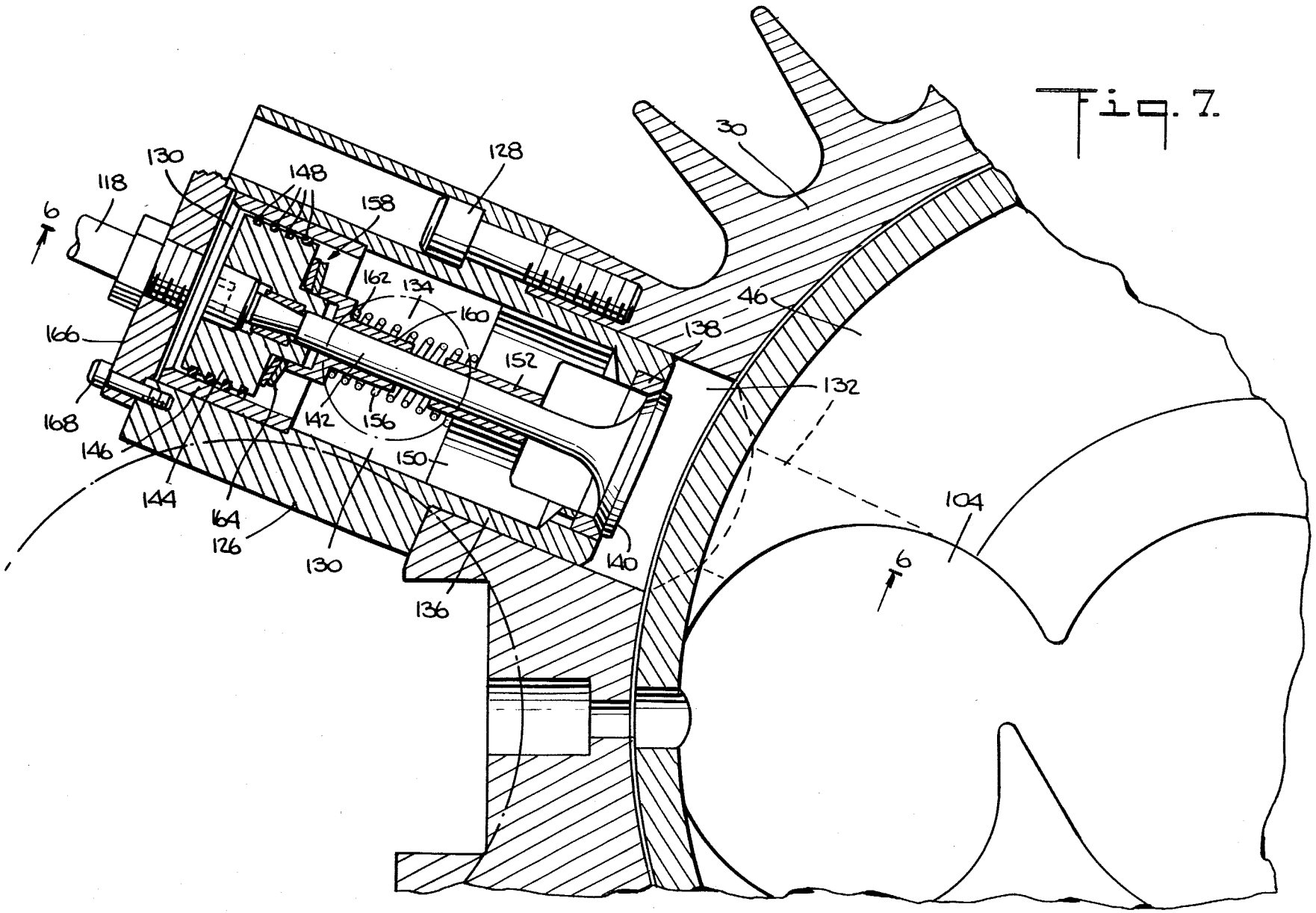
FIG. 7 is an enlarged fragmentary section view taken along line 7—7 of FIG. 3.

The poppet valve 140 has a stem 142 which extends back through the central passageway 130 of the valve block 126. The stem 142 is connected at its rearward end to a piston 144 which is fitted closely inside a sleeve 146 in the rearward portion of the valve block. As shown in FIG. 7 the piston 144 is provided with rings 148 to form a gas tight but sliding fit with the sleeve 146. The area of the forward face of the piston 144, i.e. the surface facing the valve 140 is somewhat larger than the valve so that pressure applied to the central passageway 130 produces a net force tending to pull the valve toward a closed position.

Figure 8:
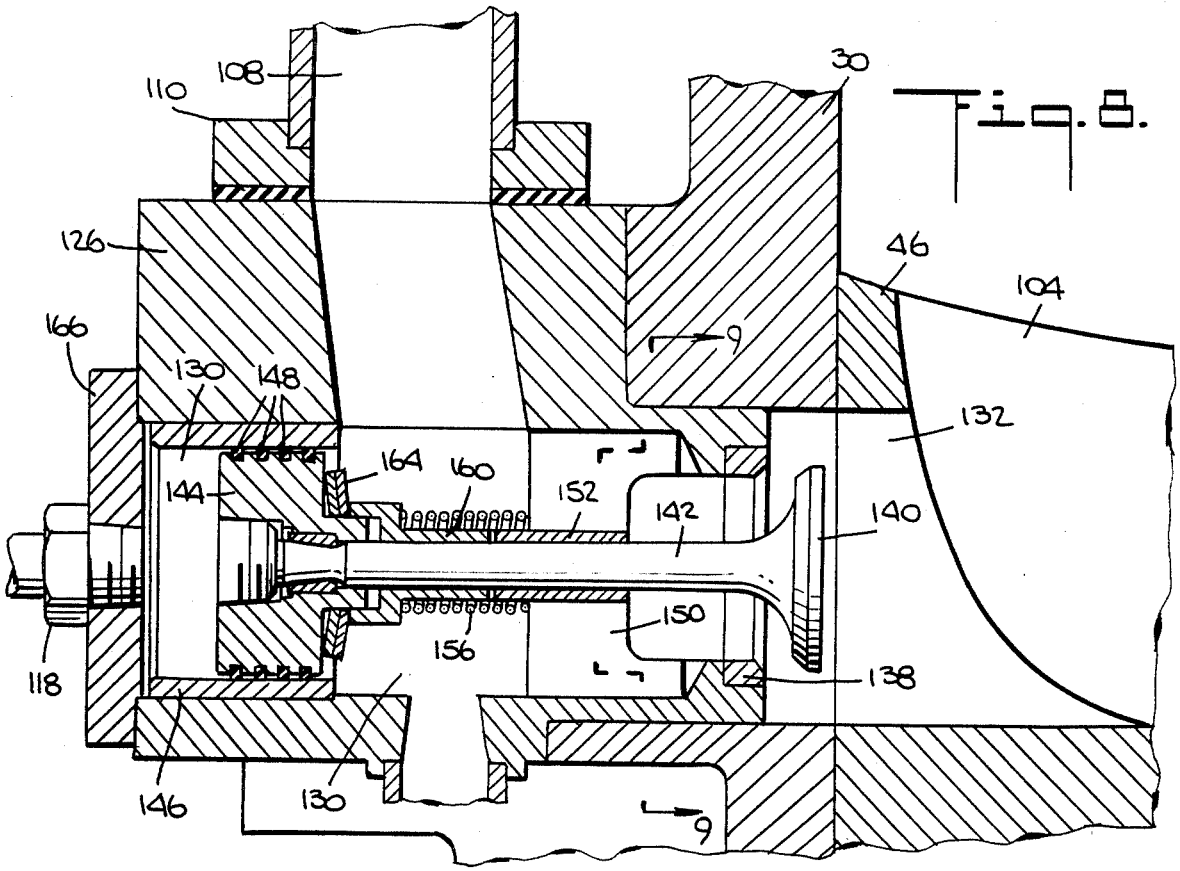
FIG. 8 is a view taken along line 8—8 of FIG. 7 but showing the compressed gas supply valve in opened condition.
Figure 9:
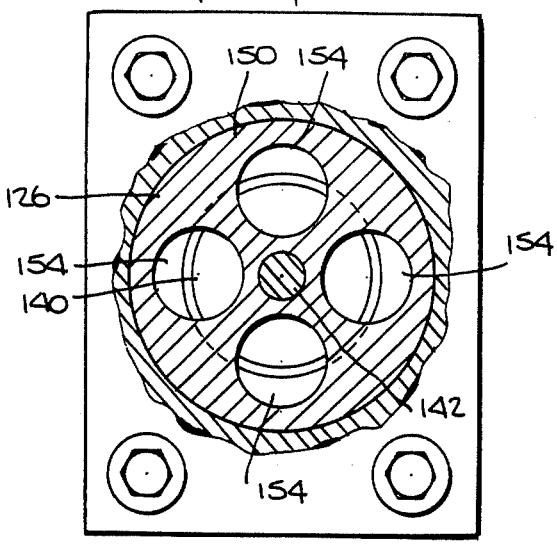
FIG. 9 is a view taken along line 9—9 of FIG. 8.

As shown in FIGS. 7–9, the interior of the valve block 126 is formed with a spider-like support 150 located in the central passageway 130 just forwardly of the inlet passageway 134. The support 150 has a sleeve portion 152 to guide the valve stem 142 so that the valve will move axially in the passageway. The support is formed with large diameter openings 154 to permit gases to flow from the inlet passageway 134 forwardly to the valve 140.

The valve 140 is further biased to a closed position seated on the valve seat 138 by means of a compression spring 156 with surrounds the valve stem 142 between the spider-like support 150 and a cushion assembly 158 which presses against the piston 144. The cushion assembly 158 comprises a sleeve 160 which closely fits over the valve stem 142 and which has a shoulder 162 to receive the end of the compression spring 156. The sleeve 160 has an enlarged rearward portion which presses against Belleville disc springs 164 resting on the piston 144.

A cover plate 166 is bolted by means of bolts 168 to the valve block 126 to cover the rear face of the piston 144. The pilot line 118 is connected via the cover plate 166 to the passageway 130 behind the piston 144. It will be noted that the area of the front side of the piston 144 (i.e. facing the valve 140) is greater than that of the side of the valve facing the piston. Therefore the pressure applied via the passageway 108 to the region between the piston and the valve will produce a net force on the piston/valve assembly in the rearward direction, tending to hold the valve closed. Now when the pilot valve 114 is opened, high pressure is applied via the pilot line 118 to the rear face of the piston 144 and the resulting net force on the piston/valve assembly is then in the forward direction, causing the valve to open.

In operation, the gas supply valve is normally closed, with the compression spring 156 forcing the piston 144 rearwardly in the passageway 130; and the piston in turn pulls the valve 140 to a sealed position resting on the valve seat 138. Although the rear surface of the poppet valve 140 is directly exposed to the high pressure air from the tank 106, this pressure does not force the valve open because the same pressure acts in the opposite direction on the forward face of the piston 144, and because of the greater area of the forward face of the piston this high pressure ensures that the valve will remain closed.

The valve 110 is opened by opening the pilot valve 114 and permitting compressed air to flow via the pilot line 118 to the rearward side of the piston 144. As explained above, this causes an unbalance of forces on the piston/valve assembly which in turn moves forwardly and opens the poppet valve 140. Compressed air then flows directly from behind the poppet valve through the passageway 132 and into the anvil cavities 102 to drive the piston 32 upwardly.

The amount by which the poppet valve 140 can open is limited by the permissible forward movement of the sleeve 160. As the piston 144 moves forwardly it pushes the sleeve 160 ahead of it until, as seen in FIG. 8, the forward end of the sleeve contacts the sleeve portion 152 of the spider-like support 150. When the valve opens, the opening movement is quite rapid and a sudden shock is produced when the sleeve 160 hits against the sleeve portion 152 of the support 150. This shock is cushioned by the Belleville disc springs 164 which permit a slight amount of continued forward movement of the valve and piston after the sleeve 160 hits against the sleeve portion 152.

Figure 10:
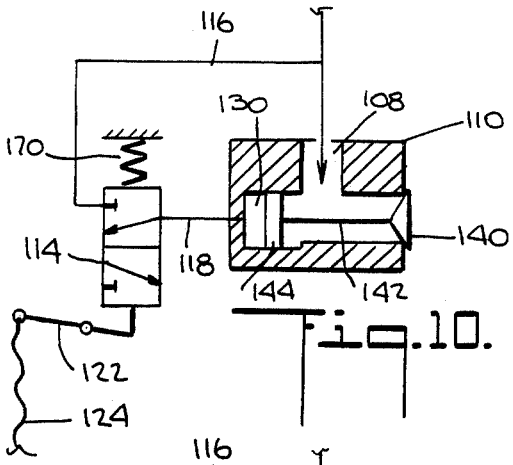
FIG. 10 is a schematic diagram showing a valve control used in the starting arrangement for the diesel hammer of FIG. 1 with the valve shown in closed condition.
Figure 11:
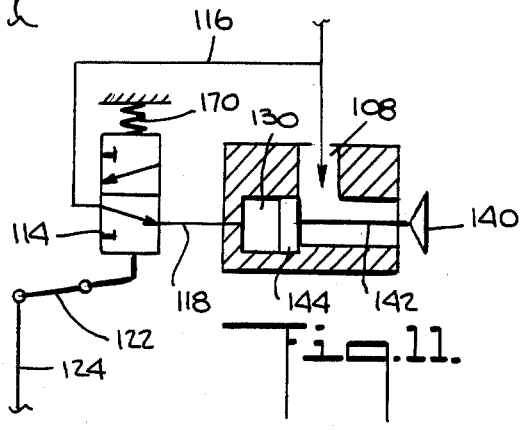
FIG. 11 is a diagram similar to FIG. 10 but showing the valve in opened condition.

The operation of the valves 110 and 114 can be seen from the schematic drawings of FIGS. 10 and 11.

As shown in FIG. 10 the pilot valve 114 is biased by a spring 170 to a position preventing pressurized gas flow via the pilot lines 116 and 118 to the pilot inlet of the valve 110 and the valve 110 remains in its closed condition. When, however, the pull cord 124 is pulled and the crank arm 122 forces the valve 114 to its actuated condition as shown in FIG. 11, it permits pressurized gas to flow via the pilot lines 116 and 118 to the pilot port 120 of the gas supply valve 110. This flow of gas causes the piston 144 and the poppet valve 140 to move forwardly so that the poppet valve opens to admit compressed air directly into the hammer casing. Thereafter, when the pilot valve 114 is released, the spring 170 returns it to the condition shown in FIG. 11 and the air trapped behind the piston 144 is allowed to vent to the atmosphere and the high pressure air applied via the inlet passageway 134, as well as the force of the compression spring 156, causes the valve to close.

This invention may of course be used to provide compressed gas starting for diesel hammers of various sizes and it will be readily apparent to those skilled in the art how the various components should be sized. In the illustrated embodiments, which is presently preferred, the invention is used to provide compressed air starting for an ICE No. 520 Diesel Powered hammer. These hammers have a ram which weighs about 5,000 lbs. (2,268 kilograms). In order to start the hammer the compressed air should provide approximately 15,000 foot pounds (20,340 joules) of energy to the ram 32, i.e. sufficient energy to raise the ram to a level of about 30 inches (76 cm.) above the anvil. This provides the ram with about 12,500 foot-pounds (16,950 joules) of potential energy due to ram height above the anvil plus about 2,500 foot-pounds (3,390 joules) of energy stored in the compressed air in the bounce chamber 72.

By providing the gas supply tank with an interior volume of about 2.67 cubic feet (0.076 cubic meters) and by charging the tank to about 250 pounds per square inch (17.2 bar) sufficient energy is available to generate a starting stroke as described above.

In order to permit successive charges of compressed gas to drive the ram up inside the casing if hammer operation does not begin on the first attempt, a compressed gas reservoir (not shown) is provided. It has been found that if the reservoir has a total volume of fifteen cubic feet (0.425 cubic meters), then by supplying the reservoir from a thirty cubic feet (0.85 cubic meter) per minute compressor at two hundred fifty pounds per square inch (17.2 bar), the receiver can recharge the tank 106 at a rate which will permit the starting operation to be repeated four successive times at intervals of about fifteen seconds.

In order to minimize pressure drop and energy losses between the gas supply tank 106 and the interior of the casing 30, the gas supply line 108, the valve passageways 130 and 134, the poppet valve 140 and the casing and anvil passageway 132 should each have a diameter of about 2 inches (5.1 cm.).

As mentioned above the present invention, in addition to providing pressurized gas starting for a diesel hammer as described above, may also provide the additional feature of converting a diesel hammer to bumpout operation in accordance with copending patent application Ser. No. 405,615.

For bumpout operation the hammer is provided as shown in FIG. 1, with an upper anvil 180 in the upper end of the casing 30. Also, removable plugs 182 are provided in the bounce chamber 72. In bumpout operation no diesel fuel is supplied to the hammer. Instead, pressurized gas is admitted to the underside of the ram 32 to drive it upwardly in the casing 30 until it strikes the upper anvil 180. By removing the plugs 182 the region above the ram is vented to permit the ram to move upwardly in the casing without compression of the air above it. By applying gas of sufficient pressure under the ram, it may be driven up high enough to impact against the upper anvil 180 to produce an uplift blow. The force of such blow is transferred down to the base adaptor 54 via external cables (not shown) which extend down from the plate on which the pulley support 68 is mounted to the base adaptor. The arrangement of such cables is shown in the above mentioned copending application Ser. No. 405,615 and that disclosure in incorporated herein by reference.

In addition, as described in application Ser. No. 405,615, covers (not shown) are installed over the intake and exhaust ports 82 and 83 so that a continuous upward force can be applied to the ram and so that the subsequent fall of the ram will be cushioned.

It will be appreciated that when the compressed gas starting arrangement of the present invention is utilized, the casing 30 does not have to be provided with slots and other openings as are required for mechanical type ram lifting devices. Consequently, the hammer is better adapted to use for bumpout operation than prior hammers beecause no special sealing and casing reinforcement structures are needed other than the intake and exhaust closure plates described above.

For cushioning the downward fall of the ram following an uplift blow the intake or exhaust plate can be provided with a vent opening which will allow a controlled outflow of air from under the ram. It has been found that such vent opening, which has a diameter of about ½ inch (1.27 cm.) does not appreciably affect the ability of the applied pressurized gas to drive the ram up to the top of the casing.

We claim:

1. A diesel hammer having self start capability, said hammer comprising a cylindrical casing, an anvil at the lower end of said casing and air inlet and exhaust ports formed in said casing above said anvil, a fuel injector for injecting combustible fuel into said casing at said anvil, a ram closely fitted inside said casing to move up from said anvil past said air inlet and exhaust ports to a predetermined level in said casing from which said ram may fall and entrap and compress air in the lower end of said casing and to deliver a blow to said anvil, a source of compressed gas, a conduit interconnecting said source of compressed gas and the inside of said casing below the ram as it rests on said anvil, a valve interposed along said conduit and a valve operating mechanism associated with said valve to open and close same, said source of compressed gas, said conduit and said valve in its open condition being arranged and diminsioned to deliver a charge of gas into said casing capable of driving said ram upwardly therein at a rate such that when the lower end of the ram clears said inlet and exhaust ports the ram will have sufficient momentum to rise ballistically to said predetermined level in said casing, said valve having a pilot prot for receiving compressed gas to operate said valve, said valve operating mechanism comprising a mechanically operated pilot valve arranged to control flow of compressed gas to said pilot port, and said valve being a poppet type valve with a stem having a poppet element on one end which rests on and lifts off from a valve seat and a piston on the opposite end of said valve stem, said piston being closely fitted to move inside a valve cylinder and said pilot port opening into said valve cylinder.

2. A diesel hammer according to claim 1 wherein said source of compressed gas is a source of compressed air.

3. A diesel hammer according to claim 1 wherein said source of compressed gas is a tank containing said gas affixed to the outside of said cylinder.

4. A diesel hammer according to claim 1 wherein said valve is located at said casing adjacent said anvil.

5. A diesel hammer according to claim 1 wherein said valve is formed with a space between said poppet element and said cylinder, said space being in communication with said conduit.

6. A diesel hammer according to claim 5 wherein the area of said piston and the area of said poppet element facing said opening are of such size as to produce a net force tending to close the valve when pressure is applied to said space.

7. A diesel hammer according to claim 6 wherein said valve is spring biaed to a normally closed condition.

* * * * *

UNITED STATES PATENT AND TRADEMARK OFFICE

CERTIFICATE OF CORRECTION

PATENT NO. : 4,580,641

DATED : April 8, 1986

INVENTOR(S) : HENRY A. N. HOLLAND and JAMES BANDURA

It is certified that error appears in the above-identified patent and that said Letters Patent is hereby corrected as shown below:

Column 6, line 8, "anyil" to read -- anvil --;

Column 10, line 32, "prot" to read -- port --;

line 59, "biaed" to read -- biased --.

Signed and Sealed this

Twenty-fifth Day of November, 1986

*Attest:*

DONALD J. QUIGG

*Attesting Officer* *Commissioner of Patents and Trademarks*